US006220774B1

(12) United States Patent
Fukushima

(10) Patent No.: US 6,220,774 B1
(45) Date of Patent: Apr. 24, 2001

(54) BALLPOINT TIP FOR BALLPOINT LIQUID CONTAINER

(75) Inventor: Makoto Fukushima, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/563,495

(22) Filed: May 3, 2000

(51) Int. Cl.[7] ..... B43K 7/10
(52) U.S. Cl. ..... 401/214; 401/209
(58) Field of Search ..... 401/214, 215, 401/216, 209

(56) References Cited

U.S. PATENT DOCUMENTS 5,655,847 * 8/1997 Kobayashi et al. ..... 401/219
5,688,061 * 11/1997 Aoki ..... 401/4
5,711,626 * 1/1998 Kobayashi et al. ..... 401/219
5,871,296 * 2/1999 Furukawa et al. ..... 401/106
5,876,142 * 3/1999 Furukawa ..... 401/209
5,984,559 * 11/1999 Shiobara et al. ..... 401/214

* cited by examiner

*Primary Examiner*—Gregory L. Huson
*Assistant Examiner*—Huyen Le
(74) *Attorney, Agent, or Firm*—McGinn & Gibb, PLLC

(57) ABSTRACT

A ballpoint tip for a ballpoint liquid container, such as a ballpoint refill, includes a tubular body member, a ball held for rotation in a tip part of the tubular body member, and a coil spring extended in the tubular body member to press the ball against the inner surface of the tip part of the tubular body member. The coil spring is formed by coiling a spring wire, a forward end part of the spring wire is extended linearly to form a straight forward end part, and a back end part of the spring wire is coiled in end coils of an outside diameter greater than that of the effective coils of the coil spring to form a large base end. The coil spring is extended with the base end thereof held in the caulked back end part of the tubular body member and the straight forward end part extended through a liquid passage and in contact with the ball. The coil spring can be strained by applying a pressure thereto through the ball.

3 Claims, 5 Drawing Sheets

BALLPOINT TIP FOR BALLPOINT LIQUID CONTAINER

BACKGROUND OF THE INVENTION

1. Field of the Invention

The present invention relates to a ballpoint tip for a ballpoint liquid container, such as a ballpoint refill using a ball as a writing medium.

2. Description of the Related Art

Most factors that determine the performance of a ballpoint liquid container for a ballpoint pen or the like are dependent on the accuracy of a ballpoint tip. A 0.7 mm diameter ball needs to rotate 44.5 full turns for drawing a line of only 10 cm, and a 0.5 mm diameter ball needs to rotate as many as 63.7 full turns for the same purpose at a very high rotating speed. Therefore, it is a very important problem with the ballpoint tip of this kind to prevent the abrasion of the ball friction necessarily caused by the high-speed rotation of the ball and the corrosional deterioration of the ball caused by static electricity generated by the high-speed rotation of the ball that occur as a logical consequence of the high-speed rotation of the ball, and to maintain the ability of the ball. If the ballpoint tip has problems in construction and accuracy, there is the possibility that "seepage" or "blotting" of the ink occurs.

A liquid applying implement disclosed in Japanese Utility Model provisional Publication No. Hei 5-76568 is an example of a ballpoint tip for a liquid container, such as a ballpoint refill of this kind. Referring now to FIG. 1, the liquid applying implement has a highly flexible liquid tank 14, and a ballpoint tip 12 provided with a ball 11 and connected to the liquid tank 14 by a connecting member 13 and a press-fit cylindrical member 17. The tank 14 contains a film-forming liquid of a high viscosity. The ball 11 is held for rotation in a forward end part of a body member of the ballpoint tip 12 so as to be partly exposed. A movable pin 15 having a small mass is placed in the body member of the ballpoint tip 12, and a spring 16 is compressed in the body member so as to push the movable pin 15 forward to press the ball 11 against the inner surface of the forward end part of the body member.

These prior art techniques applied to control a liquid, such as a gel employed in a gel ballpoint pen or a covering liquid use a ball pressing means including the movable pin formed by molding a resin, and a coil spring. These parts are difficult to assemble, springs have tendency to become tangled with each other when the pitches of the coils is greater than twice the diameter of the spring wire, and hence an automatic assembling machine cannot be used for assembling those parts, and the gel ballpoint pens or the like cannot be mass-produced.

SUMMARY OF THE INVENTION

Accordingly, it is an object of the present invention to solve the foregoing problems in the prior art, and to enable an automatic assembling machine to handle coil springs in assembling ballpoint tips by using a coil spring capable of serving as both a spring for indirectly pressing the ball and a ball pressing member in contact with the ball, forming the coil spring so that gaps between the coils of the coil spring in an unloaded state is smaller than the diameter of a spring wire forming the coil spring to prevent entangling coil springs with each other, and coiling the spring wire in end coils to form an end part of the coil spring to be held in a caulked back end part of the body member of a ballpoint tip in an outside diameter greater than that of effective coils of the coil spring so that coil springs can be suspended in the same position.

Another object of the present invention is to provide a push-button type or a cap type ballpoint liquid container containing an ink having a viscosity in the range of a low viscosity of 3.5 cps to a high viscosity of 5,000 cps at 20° C., including a ballpoint tip having a body member, a ball held in a tip part of the body member, and a spring disposed behind the ball and having a large base end held in a back end part of the body member by caulking the back end part of the body member. The ball is pressed against the inner surface of the tip part of the body member by the spring so as to close the open tip of the body member to prevent the leakage of the ink from the tip of the ballpoint tip while the ballpoint liquid container is not in use or being carried and to prevent the ink around the ball from drying up.

With the foregoing objects in view, the present invention provides a ball point tip for a ballpoint liquid container including a tubular body member, a ball rotatably held in a tip part of the tubular body member, and a coil spring formed by coiling a spring wire, inserted in the tubular body member and capable of being strained by a pressure applied to the ball; in which the coil spring has a straight forward end part formed by linearly extending the spring wire and a base end formed by coiling the spring wire in end coils of an outside diameter greater than that of effective coils of the coil spring, the coil spring is extended in the tubular body member with the straight forward end part thereof extended through a liquid passage and pressed against the ball and with the base end thereof held by a back end part of the body member by caulking the back end part.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
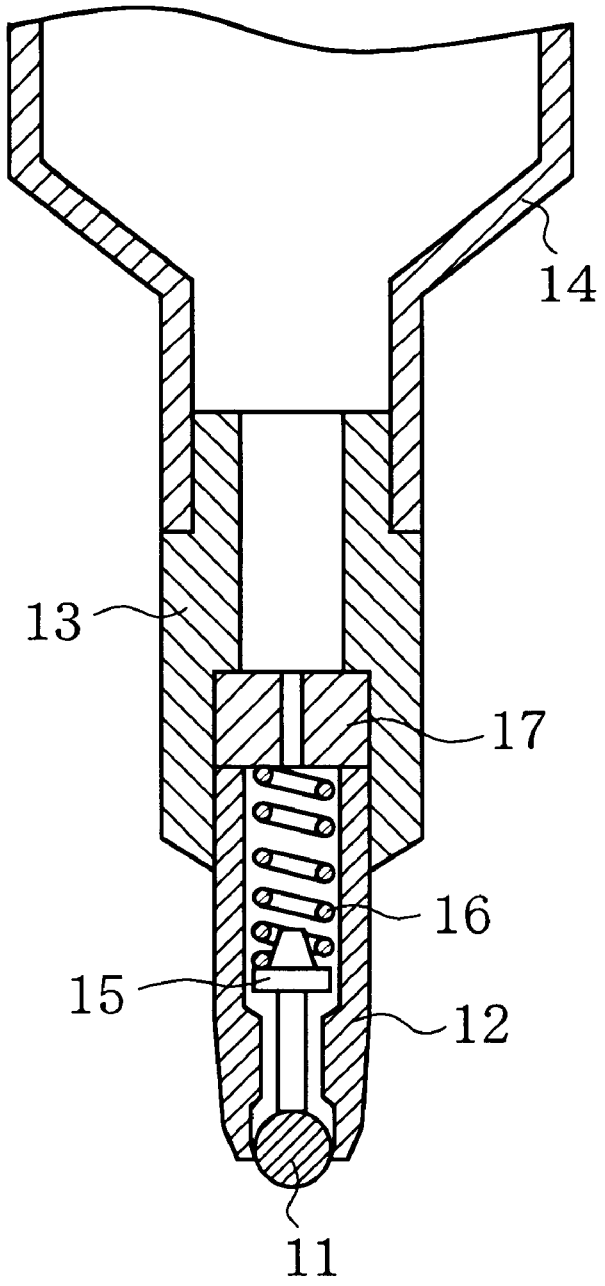
FIG. 1 (PRIOR ART)
FIG. 1 is a fragmentary longitudinal sectional view of ballpoint liquid container provided with a prior art ball point tip.
Figure 2:
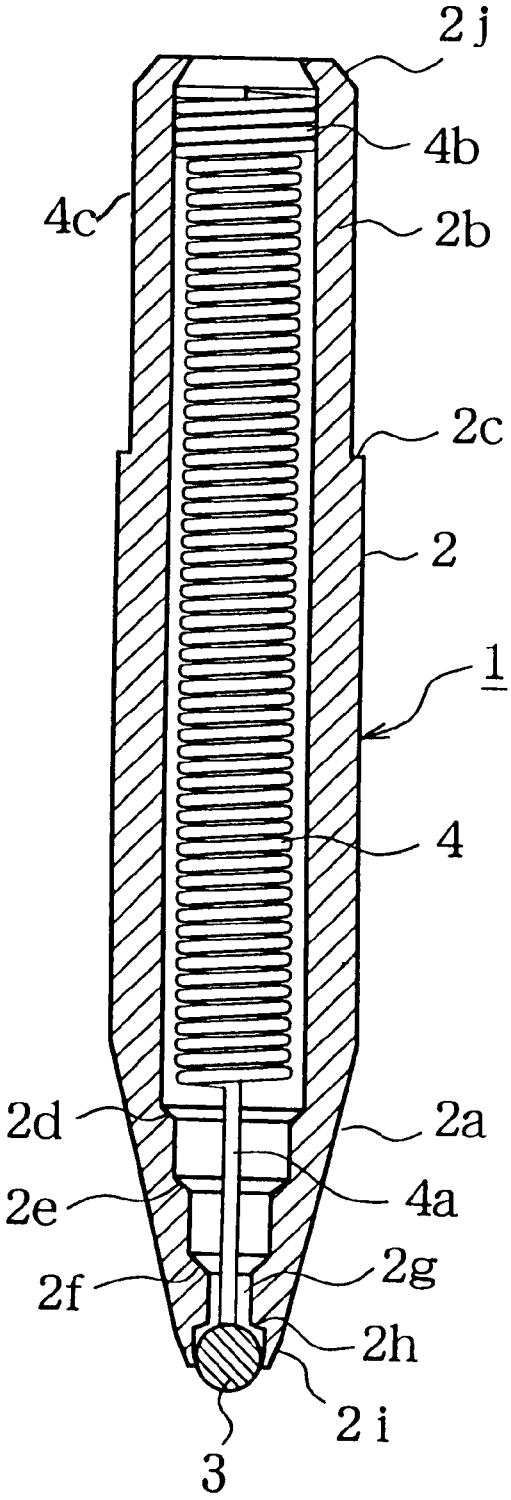
FIG. 2 is longitudinal sectional view of a ballpoint tip in a preferred embodiment according to the present invention for a ballpoint liquid container.

Referring to FIG. 2 showing a ballpoint tip 1 in a preferred embodiment according to the present invention for a ballpoint liquid container, the ballpoint tip 1 includes a body member 2, a ball 3 and a coil spring 4. The body member 2 of the ballpoint tip 1 has a forward end part 2*a*. The body member 2 has a back end part 2*b* having a reduced wall thickness demarcated by a shoulder 2*c* from a middle part of the body member 2.

The inside diameter of the forward end part 2*a* is decreased stepwise toward the tip so as to form a first shoulder 2*d*, a second shoulder 2*e* and a third shoulder 2*f*. An ink passage 2*g* is formed between the third shoulder 2*f* and the tip of the body member 2.

Figure 3:
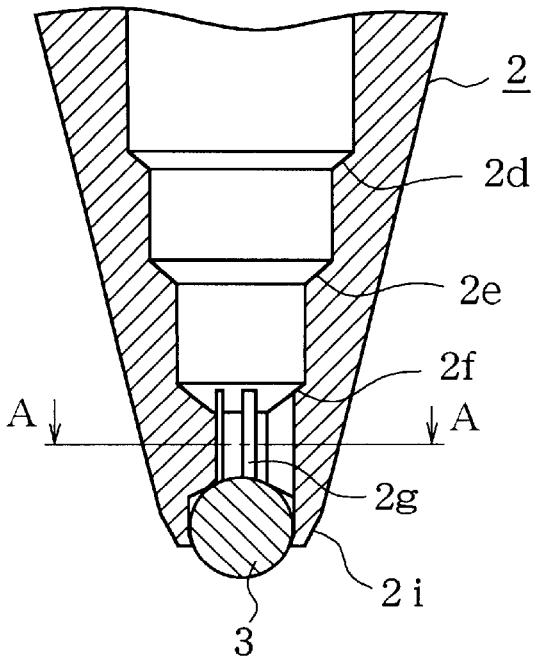
FIG. 3 is an enlarged, fragmentary longitudinal sectional view of a forward end part of the ballpoint tip shown in FIG. 2, in which a coil spring is removed.

Referring to FIG. 3 showing a forward end part of the ballpoint tip 1 shown in FIG. 2 in an enlarged, fragmentary longitudinal sectional view, the ball 3 is held for rotation in the forward end part 2*a* of the body member 2 by caulking a tip part 2*i* of the forward end part 2*a*. The ball 3 is formed of a hard material containing 96% tungsten carbide and 4% cobalt.

Figure 4:
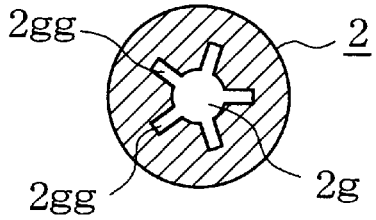
FIG. 4 is a cross sectional view taken on line A—A in FIG. 3.
Figure 5:
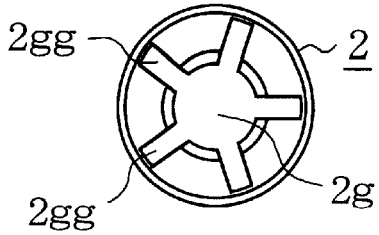
FIG. 5 is an end view taken in FIG. 3, in which a ball is removed.

Referring to FIGS. 4 and 5, the ink passage 2*g* is formed in the tip part of the forward end part 2*a* of the body member 2. The tip part of the forward end part 2*a* has a ball holding part 2*h*(FIG. 2) extending in front of the ink passage 2*g*. The ball 3 is held loosely for rotation in the ball holding part 2*h*.

The coil spring 4 is inserted in the body member 2 through the open back end of the body member 2. As shown in FIG. 2, a forward end part of a spring wire forming the coil spring 4 is extended linearly to form a straight part 4*a*. When the coil spring 4 is inserted in the body member 2, the straight part 4*a* of the coil spring 4 extends through the ink passage 2*a*, the tip of the straight part 4*a* comes into contact with the ball 3, and the coil spring 4 presses the ball 3 against the inner surface of the tip part of the forward end part 2*a* so that the ball 3 is partly exposed. In an optimum state, a part of the ball 3 corresponding to 35%–40% of the diameter of the ball 3 is exposed.

The spring wire is wound in end coils of an increased diameter to form a large back end 4*b*. A back end part 2*j* of the body member 2 is caulked to hold the large back end 4*b* therein. Although the ball 3 is held loosely in the forward end part 2*a*, the ball 3 is unable to fall off the caulked tip part 2*i* of the forward end part 2*a*.

As obvious from FIGS. 4 and 5, the ink passage 2*g* has a plurality of radial grooves 2*gg* to enable the ink to flow smoothly through the ink passage 2*g*.

Since the end surface of the straight part 4*a* of the coil spring 4 is flat while the surface of the ball 3 is spherical, the ball 3 is in point-contact with the end surface of the straight part 4*a* of the coil spring 4. Since the ball is pressed forward by the spring 4 so as to be in perfectly close contact with the inner surface of the tip part 2*i*, the ball 3 does not permit the leakage of the ink when the ballpoint tip 1 is attached to a liquid container to form a ballpoint refill.

The coil spring 4 has the large back end 4*b* of an outside diameter greater than that of the effective coils of the coil spring 4 and a step portion 4*c* between the effective coils of the coil spring 4 and the large back end 4*b*. The back end part 2*j* of the body member 2 corresponding to the large back end 4*b* of the coil spring is caulked to hold the large back end 4*b* of the coil spring 4 therein. Since the outside diameter of the large back end 4*b* is nearly equal to the inside diameter of the back end part 2*j*, the coil spring 4 can be firmly held in the body member 2 by slightly caulking the back end part 2*j* of the body member 2.

It is an important feature of the present invention that the gaps between the coils of the coil spring 4 in an unloaded state are smaller than the diameter of the spring wire forming the coil spring 4. More concretely, the diameter of the spring wire forming the coil spring 4 is in the range of 0.1 to 0.2 mm, and the pitches of the coils of the coil spring 4 is in the range of 1.5 to 1.9 times the diameter of the spring wire. The coil spring is held behind the ball 3 in the body member 2 by holding its large back end 4*b* by the caulked back end part 2*j* of the body member. Since the coil spring 4 has the large back end 4*b* of the outside diameter greater than that of the effective coils of the coil spring 4, coils springs 4 can be automatically arranged in the same direction.

Figure 6:
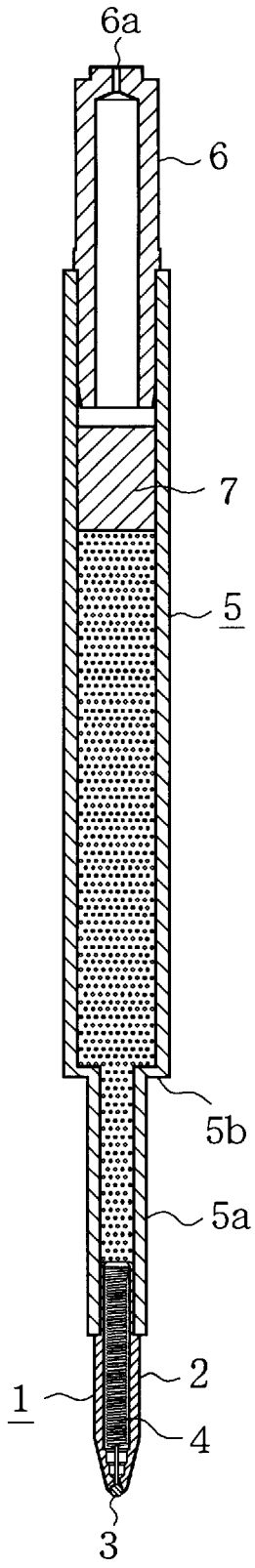
FIG. 6 is a longitudinal sectional view showing a state in which the ballpoint tip is provided with a ballpoint refill shown in FIG. 2.

FIG. 6 is a longitudinal sectional view of a ballpoint refill provided with the ballpoint tip 1. The ballpoint refill has a liquid container 5 containing a gel ink. The ballpoint tip 1 is pressed in a reduced forward part 5*a* of the liquid container 5.

The liquid container 5 has an open back end. An end plug 6 provided with a vent hole 6*a* is fitted in the back end part of the liquid container 5. A reverse flow preventing member 7 made of polybutylene or the like is inserted in the liquid container 5 so as to be in contact with the back end surface of the ink filled in the liquid container 5 to prevent the reverse flow of the ink. As the ink is consumed, the back end surface of the ink moves forward and the reverse flow preventing member 7 moves forward together with the back end surface of the ink to prevent the reverse flow of the ink.

Figure 7:
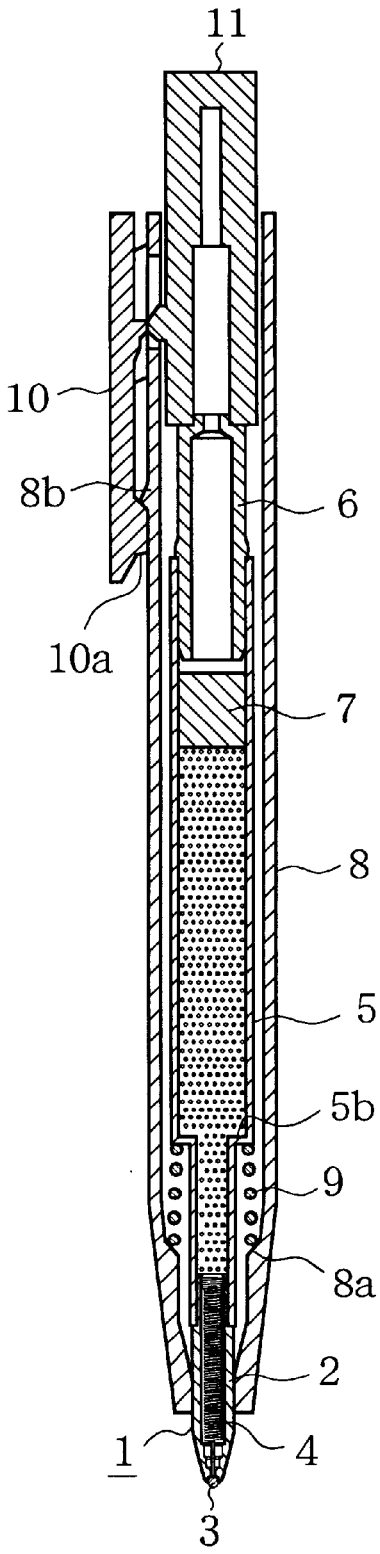
FIG. 7 is a longitudinal sectional view of a ballpoint pen formed by inserting the ballpoint refill shown in FIG. 6 in a barrel.

FIG. 7 is a longitudinal sectional view of a push-button ballpoint pen formed by inserting the ballpoint refill shown in FIG. 6 in a barrel 8. As shown in FIG. 7, the ballpoint refill is urged backward by a return spring 9 compressed between a shoulder 8*a* formed in the inner circumference of a forward end part of the barrel 8 and a shoulder 5*b* provided at the liquid container 5.

When using the ballpoint pen, a push-button 11 is pressed to advance the ballpoint refill against the resilience of the return spring 9. Then the forward end part of the ballpoint tip 3 projects from the open forward end of the barrel 8. In this state, a stopping projection 10*a* formed in the back surface of a clip 10 engages with a stopping projection 8*b* formed on the outer surface of the barrel 8 to hold the ballpoint refill in a writing state.

When retracting the ballpoint refill into the barrel 8, a back end part of the clip 10 is depressed or a front end part of the clip 10 is separated from the barrel 8. Consequently, the stopping projection 10*a* is disengaged from the stopping projection 8*b* of the push-button 11 and the ballpoint refill is returned to its original position by the return spring 9, and the tip of the ballpoint chip 1 is retracted into the barrel 8.

When assembling ballpoint tips similar to the foregoing ballpoint tips 1 for the ballpoint liquid container, a plurality of body members 2 each having a caulked tip part 2*i* holding a ball 3 are set in a vertical position on a turntable, the turntable is turned to set the body members 2 successively at a spring feed position, coil springs 4 suspended in a vertical position with their large end part 4*b* on the upper side are inserted in the body members 2 successively at the spring feed position, and the back end parts 2*j* of the body members are caulked successively to complete ballpoint tips 1. Thus the ball point tips 1 can be easily automatically assembled.

As apparent from the foregoing description, the ballpoint tip according to the present invention is provided with the coil spring 4 serving as both the spring 16 for indirectly pressing the ball 11, and the movable pin 15 in contact with the ball 11 of the prior art ballpoint tip 12, the coil spring is formed so that gaps between the coils of the coil spring in an unloaded state is smaller than the diameter of the spring wire forming the coil spring to prevent entangling coil springs with each other, and the spring wire is coiled in end coils to form the end part of the coil spring to be held in the caulked back end part of the body member of the ballpoint tip in an outside diameter greater than that of effective coils of the coil spring so that coil springs can be suspended in the same position to enable the use of an automatic assembling machine for assembling ballpoint tip for mass production.

According to the present invention, in the push-button type or a cap type ballpoint writing implement using an ink having a viscosity in the range of a low viscosity of 3.5 Cps to a high viscosity of 5,000 Cps at 20° C., the coil spring is held in the body member by caulking the back end part of the body member so as to press the ball against the inner surface of the tip part of the forward end part of the body member, so that the leakage of the ink while the writing implement is not in use can be prevented and the ink around the ball is prevented from drying up.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A ballpoint tip for a ballpoint liquid container, comprising:

a tubular body member having a tip part, a liquid passageway and a caulked back end part;

a ball held for rotation in said tip part of said tubular body member; and a coil spring inserted in said tubular body member to press said ball against an inner surface of said tip part of said tubular body member, said coil spring comprising:

a cylindrical coil body having a first outside diameter, and first and second ends;

a coiled base part extending rearwardly as a continuation of said coil body from said first end of said coil body, said coiled base part having a second outside diameter, said second outside diameter being greater than said first outside diameter;

a step portion between said coil body and said coiled base part; and a straightly extending end part extending forwardly as a continuation of said coil body from said second end of said coil body, said coil spring being received within said tubular body member with said straightly extending end part extending through said liquid passageway to press said ball against said inner surface of said tip part of said tubular body member, and with said coiled base part being seated against said caulked back end part of said tubular body member.

2. The ballpoint tip for a ballpoint liquid container as claimed in claim 1, wherein said coil spring has windings and gaps between respective adjacent windings, said gaps in an unload state are smaller than diameters of said respective adjacent windings.

3. The ballpoint tip for a ballpoint liquid container as claimed in claim 2, wherein each of said windings has a diameter in the range of 0.1 to 0.2 mm, and said coil spring in the unloaded state has pitches each of which is 1.5–1.9 times as large as the diameter of said each of said windings.

* * * * *